United States Patent [19]

Wilken et al.

[11] Patent Number: 4,724,984

[45] Date of Patent: Feb. 16, 1988

[54] DEVICE FOR THE PORTIONED DISPENSATION OF GRANULAR MEDIA, TABLETS OR THE LIKE

[75] Inventors: Josef Wilken; Ludger Hackmann, both of Lohne/Oldenburg, Fed. Rep. of Germany

[73] Assignee: Bramlage GmbH, Lohne/Oldenburg, Fed. Rep. of Germany

[21] Appl. No.: 910,961

[22] Filed: Sep. 24, 1986

[30] Foreign Application Priority Data

Oct. 3, 1985 [DE] Fed. Rep. of Germany ..... 3535292

[51] Int. Cl.[4] ..... G01F 11/10

[52] U.S. Cl. ..... 222/361; 222/453; 221/266

[58] Field of Search ..... 222/444, 453, 361, 362, 222/344, 363, 307, 305, 355, 153; 221/266, 267

[56] References Cited

U.S. PATENT DOCUMENTS

| | | | |
|---|---|---|---|
| 2,537,415 | 1/1951 | Loeb et al. | 222/361 |
| 4,209,112 | 6/1980 | Cottwell | 221/266 |
| 4,384,660 | 5/1983 | Palmisano | 222/153 |
| 4,394,941 | 7/1983 | Recine | 222/361 |

FOREIGN PATENT DOCUMENTS 3502282 7/1986 Fed. Rep. of Germany .

*Primary Examiner*—F. J. Bartuska
*Assistant Examiner*—Kenneth Noland
*Attorney, Agent, or Firm*—Collard, Roe & Galgano

[57] ABSTRACT

A device for dispensing granular media or tablets in portions from a supply space therein is disclosed. The device comprises a casing having an outlet sealable by a normally closed spring-loaded tappet. The device also includes an actuating system located within a recess in the outer walls of the casing. The tappet emerges from an internal wall within the casing. The wall forms an internal shaft for supporting the tappet and spaces the tappet from the outer walls of the casing. The internal wall also forms a space between an outer walls and a supply space which is open towards the recess and allows for easy formation of the casing. The supply space has a lower portion from which there extends a duct which forms the outlet for the device. The tappet has an opening therethrough at a lower end thereof capable of being moved in front of the duct when in a dispensing position. The supply space is then sealed by an insert located within the lower portion of the supply space. The insert has a guide wall capable of isolating the supply space from the opening in the tappet when the tappet is in the dispensing position and wherein the actuating device slides within the recess and the casing walls to thereby move the tappet from its normally closed position to its dispensing position.

16 Claims, 8 Drawing Figures

M
8'
P
z
7
6
5
1
V
9
10
11
9'
12'
VI
12"
8
a
13
14
25
21
21'
18
19
16
20
36
37
x
32
31
15
17
38
30
35
12
33
17'
23
23'
24
27
26
VII
34
y
28
2'
8"
22
22'
3
2
b

II
30
VII
c
31
32
I
13
a
37
18
19
36
24
b
23
27
8
12
14
d
34
33
38
35
3

DEVICE FOR THE PORTIONED DISPENSATION OF GRANULAR MEDIA, TABLETS OR THE LIKE

The invention relates to a device for the portioned dispensing of granular media, tablets or the like from the supply space of a casing. The casing has a discharge opening that is sealable by means of a tappet which is spring-loaded in the closed direction. The casing also has a recess having seated within its zone, an actuating device, which is arranged on the tappet that exits from the wall of the casing. The latter forming in the interior a duct for supporting the tappet spaced from the walls of the casing.

A device of this type is the object of U.S. Pat. No. 3,502,282 of the same Applicant.

The objective of the invention is to design a device in such a way that the conditions for its manufacture by injection molding are enhanced. Also, the device can be handled with greater ease, permitting high dispensing safety and complete discharge of the contents even when dispensing the smallest amount.

This objective is accomplished by the features of the invention disclosed in claim 1.

The subclaims disclose additional beneficial features of the device according to the invention.

Based on such design features, a device of the type specified above is created which, on the one hand, enhances the manufacturing conditions for injection molding, and permits easy handling on the other hand. The open space between the walls of the casing is open towards the recess, which facilitates the removal of the device from the mold. The recess is closed again by the actuating device. The bottom is inserted from the other side. The zone of the casing disposed in that direction, which partly forms the open space and partly the supply space, can be readily removed from the mold as well. The duct forming the discharge opening forms a material bridge connecting with the duct guiding the tappet, which contributes to the stabilization of the device. The latter can be realized as a pocket model, in which case it is important that the inherent stability of the device is as high as possible. The tappet has a passageway that can be shifted or moved in front of the duct. In the dispensing position, the inside end of such passageway is sealed by a guide wall of the insert part inserted in the supply space. In this way, the casing, which has an open edge on the bottom side, is stiffened further. The passageway along with in the tappet assures safe singling of the contents or exact doses. The additional feature of having the actuating device, which is connected with the freely projecting end of the tappet, slide along the inner surface of the outer wall of the open space serves the purpose of good tappet guidance. Furthermore, the invention provides for a space beneath the duct forming the discharge opening, such space being open towards the bottom side of the casing. In this way, it is possible to selectively move the dispensing passage relative to the section of the bottom. The centrally disposed duct for the tappet and the space gained by the spacing relative to the walls of the casing offer an opportunity for including additional safety features especially to protect against misuse by children. In this regard, a safety feature is provided which includes an angular safety key and locking arm. The arm is capable of swinging from a locking position in an opening of the tappet and swivelling into the open space, whereby it is disposed crosswise relative to the cross section of the duct. In this way, the duct serves to support the safety key. Consequently if the actuating device is depressed first in the direction of release of the contents then, the actuating force admitted via the tappet is transmitted to the duct, which protects the bearing points of the safety key. In this connection, it is favorable, furthermore, that the safety key is disposed beneath the bottom wall of the recess and supported between this bottom wall and a parallel wall disposed with a space beneath such bottom wall. The walls define a laterally open recess designed to receive the safety key both upwardly and downwardly. Thus a highly stable, stiffened, zone of the casing is produced. This is important in light of the fact that the pressure not exactly applied to the key may deform the casing mainly with thin-walled devices. Furthermore, it is proposed that the duct and tappet have a square cross section; in this way, the passageway will safely retain the alignment it requires to function properly. In this connection, it is advantageous, furthermore, that the guide wall is the bridge of a U-profile, whose legs contribute to the guidance of the tappet by closely surrounding the latter. Furthermore, it is favorable that the end or final position of the insert part forming the bottom of the supply space is stop-limited by bridges of the casing. Another advantageous feature of the invention is that within the zone of the lower end of the duct, the tappet forms a stop defining the basic position. Finally, another feature that is beneficial to the dispensing function is that the passageway extending between the bottom slopes downwardly in the direction of dispensing. The duct slopes downwardly in the same direction with the latter being disposed lower by the length of the activation stroke of the tappet. The duct has a steeper downward slope, which leads to a more favorable sliding behavior, so that the passageway functioning as the dosing chamber is filled all at once and without utilizing the filling load. Finally, another beneficial feature is that when the device is in the basic position, the bottom surface of the passageway is vertically spaced from the edge of the bottom on the tappet side. The corresponding displacement of the cross section of the passageway towards the final section determines the cross section of the feed. This leads to a lower-lying filling throat, which is practically neutralized with respect to the filling load pressure, so that jamming or clogging of the contents directly present on the dispensing side in the passageway is avoided.

The object of the invention is explained in greater detail by reference to the embodiment shown in the drawing, in which.

Figure 4:
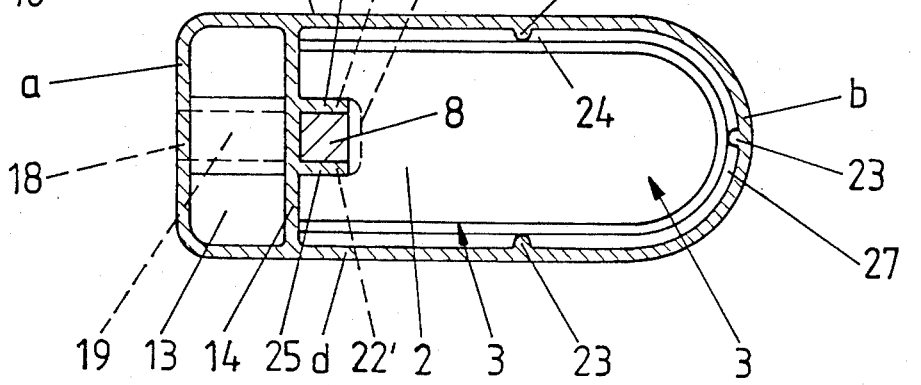
FIG. 4 is a sectional view showing a cut along line IV—IV in FIG. 3.

The device designed as a dispenser for the dosed dispensation of finely granular, pearl-shaped (so-called pellets) or powdered contents including tablets has a plastic casing 1 manufactured by injection molding. This case is relatively flat and FIG. 4 shows that it has a basically oblong, rectangular cross section.

The casing 1 incorporates a supply space "V", which is filled from the open cross section of the bottom and thereafter sealed by means of an insert part 3 forming a pan-shaped bottom 2. The filling material, which are small pearls in the present case, is denoted by reference numeral 4. The ceiling 5 of the supply space "V" is sealed. The core of the injection mold is pulled off in the counter direction, thus at the bottom side, or the casing 1 is removed therefrom by blowing.

On the side of the ceiling, provision is made for an open recess 6, which is open upwardly. For the purpose of obtaining the greatest possible freely projecting actuating surface of the actuating device 7, such recess has a width extending across the total transverse width of the casing and is seated on a tappet 8 projecting from the wall of the casing, such tappet being part of the discharge mechanism "M" of the dispenser, which mechanism should be accommodated in the casing as centrally as possible. The vertically displaceable tappet 8 may be produced by injection molding as one piece with the actuating device 7, which is a key that is spring-loaded in the direction of the basic position of the tappet 8, or connected with such device by a clip or clamp, which is preferred in the present embodiment. For this purpose, the cap-shaped actuating device has a bushing 9 mounted on its underside, that is, the bushing is pointed downwardly, starting from the ceiling of the cap. Its interior space has the arresting projections 10, which cooperate with the locking recesses of the end 8' of the tappet.

For the limitation of the vertical movement of the tappet, the downwardly pointing face end 9' of the bushing 9 comes into contact with the corresponding face end 12' of a duct 12 guiding the tappet 8. This duct is disposed spaced from the walls "a" to "d" of the casing on all sides. The walls "a" and "b" of the casing are narrow side walls and the other walls are wide side walls.

The space 13 having the spacing "x" relative to the narrow side wall "a" on the left side is open toward the recess 6. The core molding such space 13 and at the same time the recess 6 is pulled off upwardly, that is on the side of the ceiling.

The partition between space 13 and the supply space "V" forms a vertical transverse wall 14 which, in the upper zone, changes into a correspondingly aligned section of the duct 12, or it forms this section of the duct. The transverse wall extends in the shortest possible way from the wide side wall "c" to the wide side wall "d" of the casing 1 and is rooted therein. In the vertical direction, the transverse wall extends from the horizontal bottom wall 15 of the recess 6 up to the upright edge 16 of the casing on the bottom side. The top side of the bottom wall 15 is flush with the top face end 12' of the duct 12.

Figure 1:
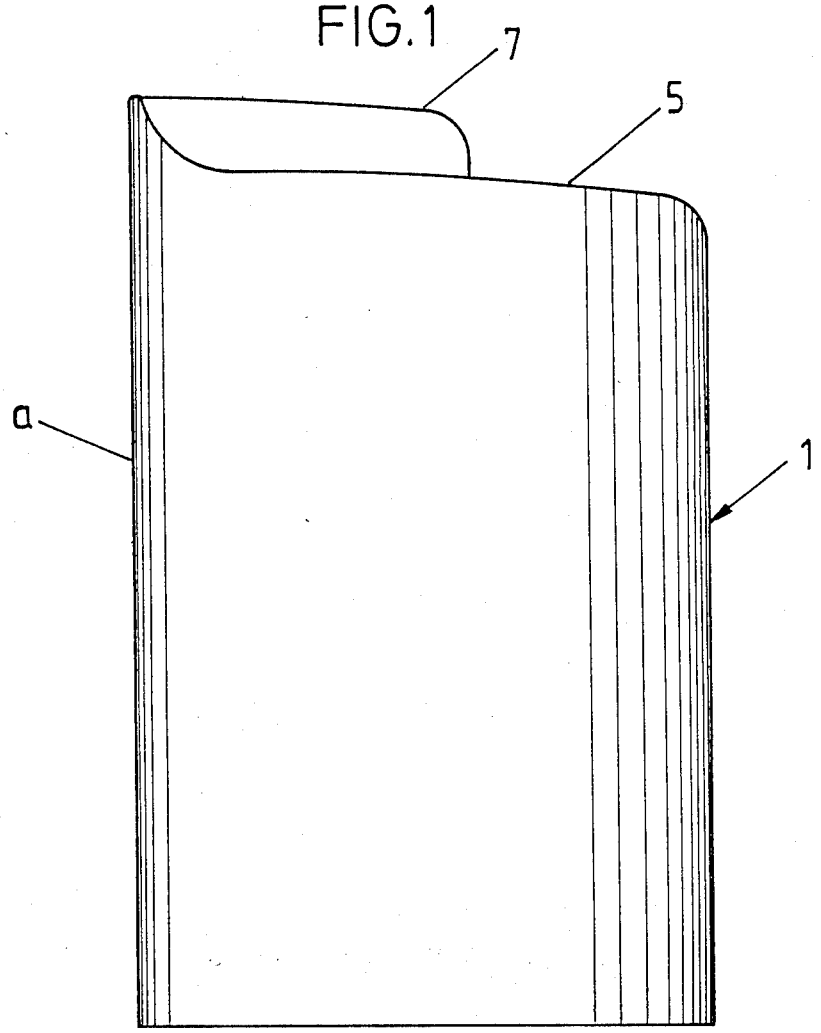
FIG. 1 is a lateral view of the dispenser shown by an enlarged view.
Figure 2:
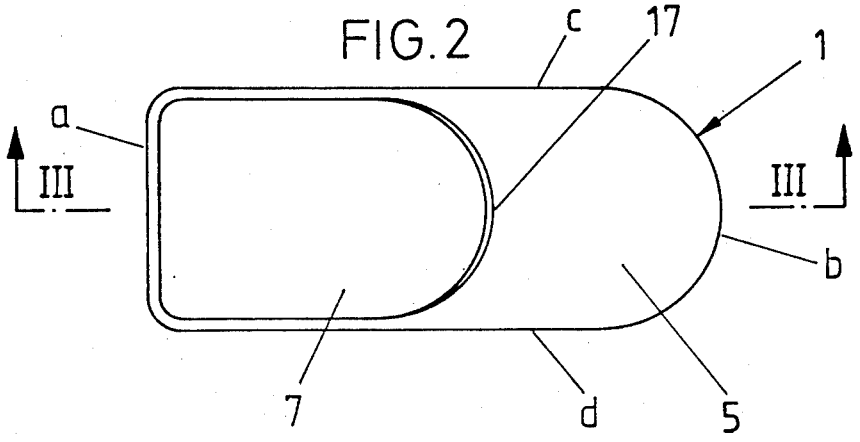
FIG. 2 is the top view of the device of FIG. 1.
Figure 3:
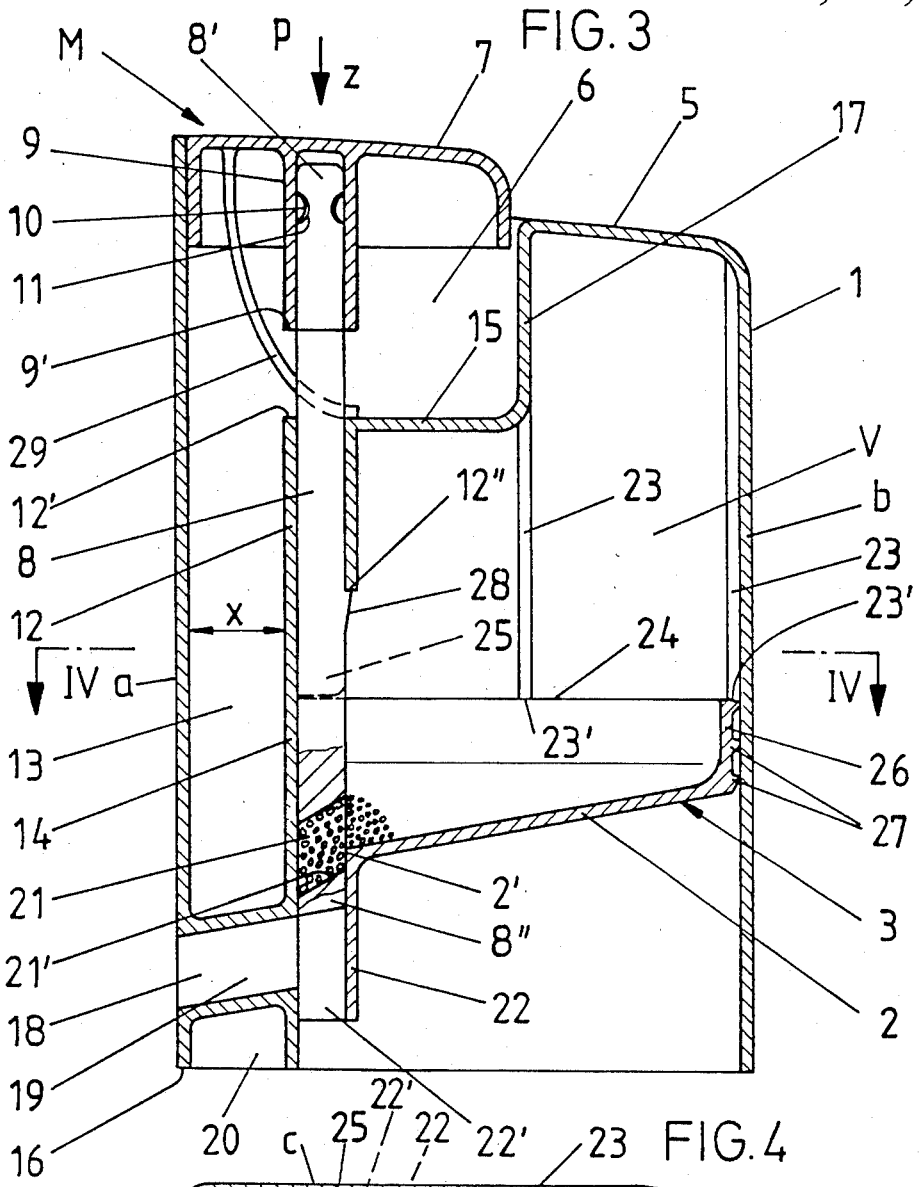
FIG. 3 is a sectional view showing a cut along line III—III in FIG. 2.
Figure 5:
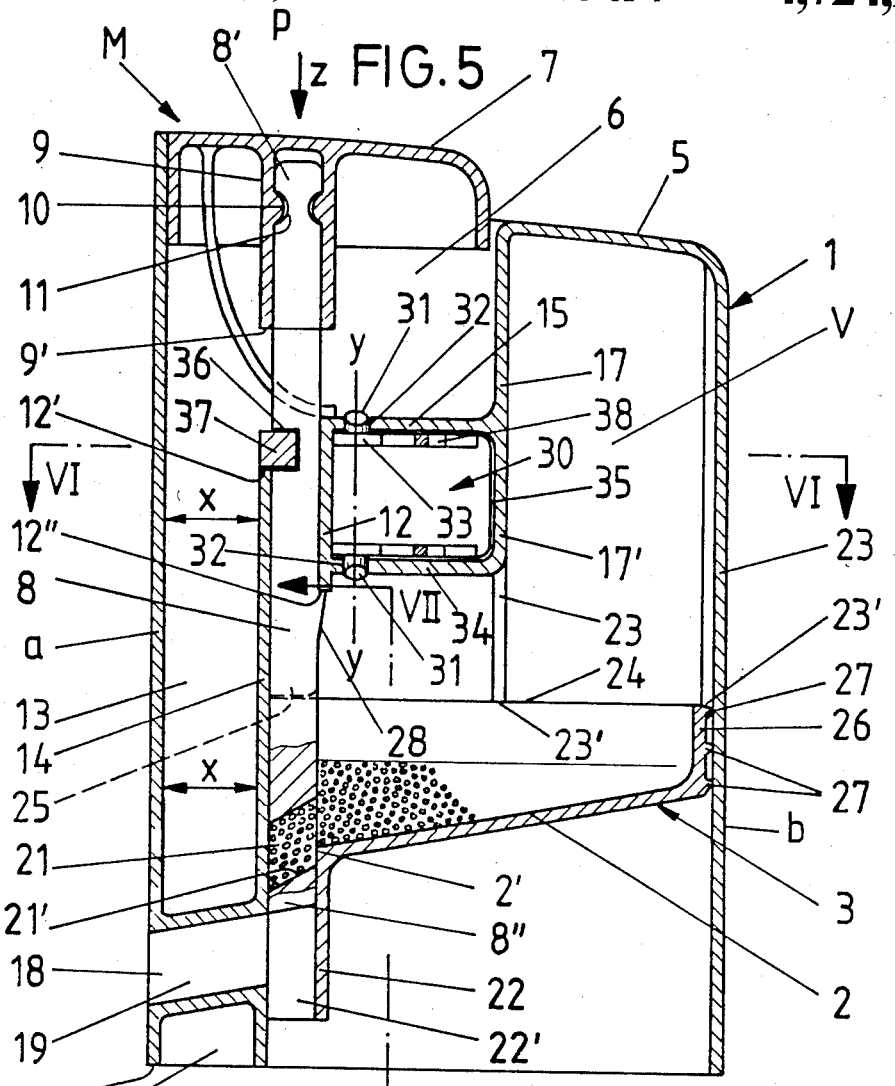
FIG. 5 shows a vertical section conforming to FIG. 3, through a device incorporating features protecting it against misuse by children.
Figure 6:
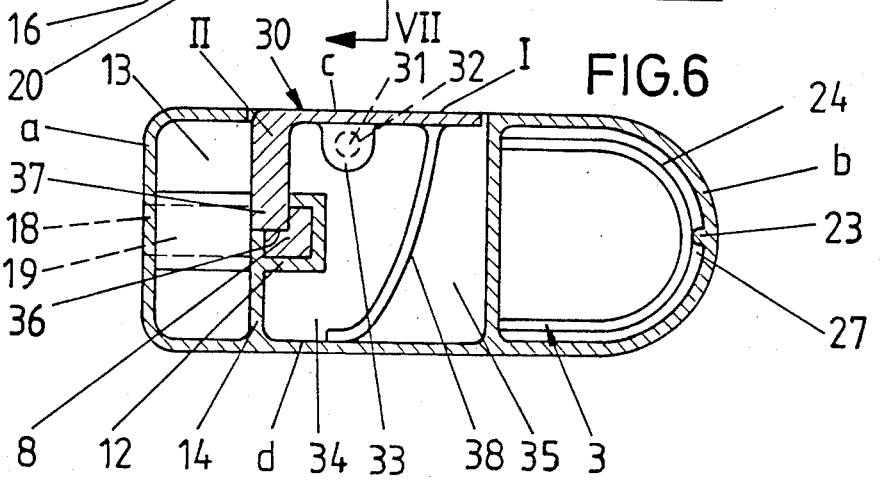
FIG. 6 is a sectional view showing a cut along line VI—VI in FIG. 5, with alternating displacement of the cutting plane.
Figure 8:
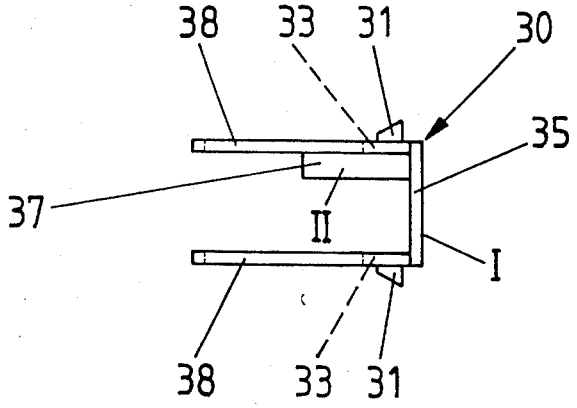
FIG. 8 is a single representation showing a lateral view of the safety key.
Figure 7:
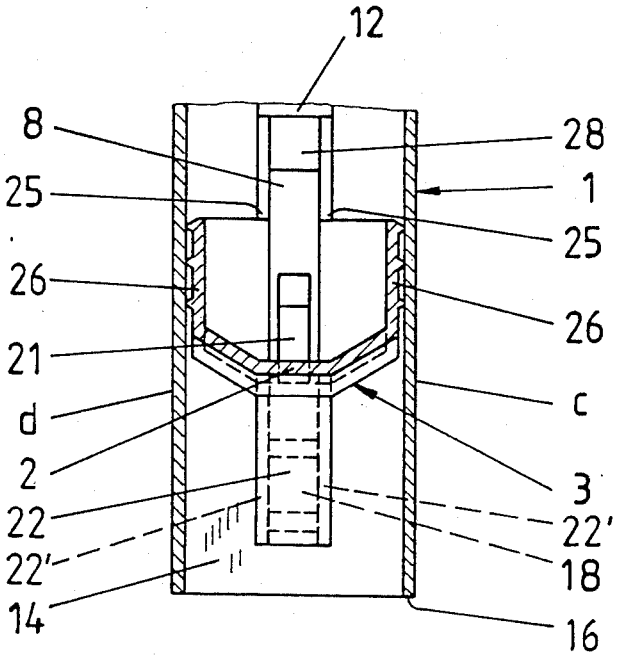
FIG. 7 is a sectional view showing a cut along line VII—VII in FIG. 5.

The projection of the bottom wall 15 on the right side is almost in conformity with the depth (spacing "x") of the space 13 in the counterdirection, so that the actuating force if centrally received in the tappet in spite of the relatively large surface of the key. FIGS. 2, 3 and 5 show that the actuating device is guided along the inside surface of the outer wall of the space or opening 13, such outer wall being formed by the one narrow side wall "a". Mainly FIG. 2 shows that this guiding surface extends into the inner surfaces of the wide side walls "c" and "d" within the zone of the recess 6. However, a small inside spacing or gap exists with respect to the vertical wall 17 extending from the bottom wall 15 up to the ceiling 5. Such spacing having the shape of a half-moon-shaped gap between the inner surface on the recess side and the corresponding surface of the actuating device 7.

A duct 19 forming a discharge opening 18 for the filling material extends between the narrow side wall "a" on the left side and the transverse wall 14, such duct being slightly sloped downwardly in the dispensing direction. Its width conforms to the cross section of the square tappet 8. The height of the duct is selected slightly greater. The shaft forming the duct 19, viewed in the plane of the cross section, is self-supporting towards the space 13, and thus open towards the underside of the casing 1 as well. The space disposed beneath the duct 19 is denoted by reference numeral 20. In this way, nothing obstructs the formation of a downwardly directed discharge passage for the filling material. The discharge opening 18 would have to be kept closed and the section of the duct on the bottom side open by a core that can be pulled out dowanwardly.

The practically gate-like transfer of the filling material 4 from the supply space "V" to the duct 19 is accomplished by way of a passageway 21 in the bottom end 8'' of the tappet 8, which passageway can be moved or shifted vertically to in front of the duct 19 accordingly. In the spring-loaded basic or closed position of the tappet, this passageway 21 is open towards the supply space "V" and closed towards the transverse wall 14, which practically represents an extension of the duct 12. The bottom surface 21' of the passageway 21, which surface slopes downwardly in the dispensing direction, clearly extends beneath the plane of the inclined bottom surface 2 with a ratio of about 1:3 relative to the height of the cross sectional opening 21. This leads to a lower-lying filling throat. By applying an actuating force "P" in the direction of the arrow "z" to 7, the passageway 21 is fully immersed beneath the plane of the bottom 2. The edge 2' of the bottom 2 on the side of the tappet functions as a dividing finger, so that when the tappet is displaced in depth, an exactly dosed amount of filling material is delivered to the duct 19 for dispensation by way of the discharge opening 18 on the side of the wall. In this dispensing position, the side of the passageway 21 that was closed before by the transverse wall 14 is released, and the side facing the supply space "V" is closed by the insert part 3. The latter is extended beneath the bottom 2 in the form of a vertical guide wall 22 extending close to the upright edge 16 of the casing 1. The guide wall 22 is the bridge of a U-profile whose two legs 22', in the lower zone, contribute to the guidance of such bridge by resting form-locked on the tappet 8, so that an annularly closed shaft or duct is realized in this location as well; however, with participation of two basic components, that is, by using the section of the transverse wall 14 in that location as the fourth wall of the shaft or duct, which has a square cross section in this location as well. FIGS. 3 and 5 show that the passageway 21 extending between the bottom 2 sloping downwardly in the dispensing direction, and the duct sloping downwardly in the same direction, the latter being disposed lower by the actuating stroke or length of the stroke of the tappet 8, has a clearly steeper slope than the other parts functioning as a slide. Preferably, the bottom 2 and the duct 19 have an angle of gradient of 10°, whereas the gradient of the passageway comes to about 30°.

In the inserted position, the final or end position of the insert part 3 forming the bottom 2 of the supply space "V" is defined by the vertically arranged bridges 23, that is, on the inner surface of the wall of the casing. The horizontal edge 24 of the insert 3 comes into contact with the downwardly pointed face area 23' of such bridges. Within the zone on the tappet side, contact is established between the edge 24 and the downwardly pointed face side of the U-shaped leg extensions 25 of the duct 12. In addition, the side walls 26 of the insert 3, which are adapted to the inside contours of the casing, are provided with horizontally extending ribs 27, which practically act as sealing lips and produce a forced fit-like friction grip between the inside surface 1 of the casing and the insert part 3. The transverse wall 14 forms the end of the wall on the tappet side.

Within the zone of the lower end of the shaft, a stop defining the basic position is shaped on the tappet 8 by molding, This stop is a projection 28 with a bevelled back similar to a locking or arresting nose. The horizontal flank of this nose grips under the lower face end 12" of the shaft 12. The bevelling serves the purpose of facilitating the snap connection between the tappet 8 and shaft 12. Provision is made for sufficient clearance between such tappet and such shaft. The projection 28 is shown in a slightly overdrawn way.

The return spring for the tappet 8 is formed by the leaf springs 29 molded on the actuating device; their abutment is the bottom wall 15 of the recess 6. These leaf springs are rooted in the slidingly guided, left top corner of the actuating device, from where they extend, if need be, with low initial stress in a flat curve to the bottom wall 15, which leaves sufficient space to the right for the deformation of the springs.

On the left side, the narrow side wall "a" of the casing is flush with the top side of the actuating device 7. The remainder changing into the wide side walls "c", "d" is recessed to the height of the ceiling.

According to FIGS. 5 to 8, the device of the invention incorporates additional features protecting it against misuse by children, while retaining its basic structure or design. For this purpose, a safety key is inserted in the one wide side wall "c" of the casing 1 with a spacing relative to the actuation zone of the actuating device. This safety key has to be operated before the actuating key is depressed. The safety key is denoted by the reference numeral 30; it is supported within the proximity of the wall on a vertical axis y—y, which is formed by two axle journals 31 projecting in the counterdirection and spring-bolted or spring-locked in the bearing eyes 32. The spring action is produced by the lugs 33 molded on the safety key 30, such lugs freely projecting horizontally from the safety key 30. So as to facilitate the locking movement, the face sides of the axle journals 31 are bevelled so as to form run-up ramps. The one bearing eye 32 is disposed in the bottom wall 15 of the recess 6, whereas the second bearing eye 32 is disposed in a parallel wall 34 disposed with a vertical spacing beneath the bottom wall 15. These walls and a downwardly pointed extension 17' of the vertical wall 17 define a recess 35 designed to receive the safety key, such recess 35 extending in depth across the total transverse width of the casing.

The safety key 30 is designed with two arms. The one arm I extending exclusively in the plane of the one wide side wall "c" of the casing forms the actual operating surface, whereas the arm II, which is angled inwardly relative to the casing in the end section, is formed by the locking arm 37, which is capable of swivelling from a locking opening 36 of the tappet 8, giving way by swinging into the space 13. Also, the drawing shows that the locking arm 37 is disposed crosswise relative to the square cross section of the shaft 12, which is cut back according within this zone, now forming with its face end 12' a supporting shoulder in the corner zone of two converging walls of the shaft, which supporting shoulder keeps away loads from the safety key 30.

The curved leaf springs 38 extend from the arm I of the safery key 30 and load the latter in the direction of the basic locking position protected by the tappet and shaft. Such leaf springs are equally molded on the safety key 30. Their free ends are supported on the inside surface of the wide side wall "b" of the casing, which wall is averted from the key.

The function is briefly explained as follows: For the dispensation of the contents 4, the safety key 30 - if provided for the device - has to be operated first, which causes the locking arm 37 to swivel from the locking opening 36 of the tappet. This clears the way for the displacement of the tappet in the releasing sense. By releasing both parts, the safety key 30 and the mechanism of the dispenser are returned to their basic locking positions under spring load.

All novel features described in the specification and shown in the drawing are essential to the present invention, including those not expressively claimed in the claims.

We claim:

1. A device for dosed dispensing of granular or tableted media comprising:

a casing having outer walls defining, at least in part, an interially disposed supply reservoir for said media, an outlet opening, a recess, an open space in communication with said recess but separated from said supply reservoir by at least one inner wall defining, at least in part, a shaft spaced from said outer walls and a duct merging with said outlet opening and at least one bottom wall defining the base of said supply reservoir;

a spring-loaded tappet slidably mounted in said shaft so as to be spaced from said outer walls, said spring-loaded tappet having a passageway therethrough, said passageway having an outer and an inner end thereof, said tappet movable between an open and a normally closed position with respect to said duct merging with said outlet opening, said inner end of said passageway is in communication with said supply reservoir and said outer end of said passageway is sealed by said shaft when said spring-loaded tappet is moved to said closed position and the outer end of said passageway is aligned with said duct when said spring-loaded tappet is moved to said open position;

a guide wall extending from said bottom wall defining the base of said supply reservoir, said guide wall disposed adjacent said shaft so as to seal the inner end of said passageway when said tappet is moved to said open position; and actuating means disposed within said recess of said casing and mounted on said tappet ad slidable along the inner surface of the casing wall defining the outer limit of said open space for effecting movement of said tappet between said normally closed and said open position.

2. A device according to claim 1, wherein said outer walls of said casing beneath said duct merging with said outlet opening form a second recess which is open towards the bottom of said casing.

3. A device according to claim 2, wherein said bottom wall defining the base of said supply reservoir is formed by an insert inserted within said second recess and wherein said casing walls have stops which define the end position of said insert forming the base of the supply reservoir.

4. A device according to claim 1, wherein said casing includes a locking arm of an angularly shaped safety key, said tappet having an opening for receiving said locking arm, said locking arm being capable of swinging from a locked position within said opening in said tappet to an unlocked position within said open space defined by said inner wall.

5. A device according to claim 4, wherein said locking arm is disposed between opposed side walls of said outer walls of said casing and wherein said locking arm rotates in a plane perpendicular to said opposed side walls.

6. A device according to claim 5, wherein said recess in said casing has a bottom wall and said casing has a support wall spaced below said recess bottom wall and parallel thereto, said recess bottom wall and said support wall defining a lateral opening between said opposed side walls of said casing for receiving said safety key.

7. A device according to claim 1, wherein the cross sections of said duct merging with the outlet opening and said spring-loaded tappet are square.

8. A device according to claim 1, wherein said shaft is formed by said inner wall, a pair of tappet support walls extending inwardly from said inner wall and forming a U-shaped pocket capturing said spring-loaded tappet and said guide wall forming a bridge for said U-shaped pocket.

9. A device according to claim 1, wherein said tappet has a stop defining the closed position.

10. A device according to claim 1, wherein said passageway in said spring-loaded tappet and said duct slope downwardly in the same direction, said duct being disposed lower than said passageway by the distance moved by said passageway as said tappet is moved from said closed to said open position, said passageway having a steeper downward slope than said duct.

11. A device according to claim 1, wherein said passageway has a bottom surface which, in the closed position, is disposed vertically above said base of said supply reservoir.

12. A device for dosed dispensing of granular or tableted media comprising:

a casing having outer walls defining, at least in part, an interiallly disposed supply reservoir for said media, an outlet opening, a recess, an open space in communication with said recess but separated from said supply reservoir by at least one inner wall defining, at least in part, a shaft spaced from said outer walls and a duct merging with said outlet opening and at least one bottom wall defining the base of said supply reservoir;

a spring-loaded tappet slidably mounted in said shaft so as to be spaced from said outer walls, said spring-loaded tappet having a passageway therethrough, said passageway having an outer and an inner end thereof, said tappet movable between an open and a normally closed position with respect to said duct merging with said outlet opening, said inner end of said passageway is in communication with said supply reservoir and said outer end of said passageway is sealed by said shaft when said spring-loaded tappet is moved to said closed position and the outer end of said passageway is aligned with said duct when said spring-loaded tappet is moved to said open position;

a guide wall extending from said bottom wall defining the base of said supply reservoir, said guide wall disposed adjacent said shaft so as to seal the inner end of said passageway when said tappet is moved to said open position actuating means disposed within said recess of said casing and mounted on said tappet and slidable along the inner surface of the casing wall defining the outer limit of said open space for effecting movement of said tappet between said normally closed and said open position; and a locking arm of an angularly shaped safety key mounted on said casing, said tappet having an opening for receiving said locking arm, said locking arm being capable of swinging from a locked position within said opening in said tappet to an unlocked position within said open space defined by said inner wall.

13. A device for dosed dispensing of granular or tableted media comprising:

a casing having outer walls defining, at least in part, an interiallly disposed supply reservoir for said media, an outlet opening, a recess, an open space in communication with said recess but separated from said supply reservoir by at least one inner wall defining, at least in part, a shaft spaced from said outer walls and a duct merging with said outlet opening and at least one bottom wall defining the base of said supply reservoir;

a spring-loaded tappet slidably mounted in said shaft so as to be spaced from said outer walls, said spring-loaded tappet having a passageway therethrough, said passageway having an outer and an inner end thereof, said tappet movable between an open and a normally closed position with respect to said duct merging with said outlet opening, said inner end of said passageway is in communication with said supply reservoir and said outer end of said passageway is sealed by said shaft when said spring-loaded tappet is moved to said closed position and the outer end of said passageway is aligned with said duct when said spring-loaded tappet is moved to said open position;

a guide wall extending from said bottom wall defining the base of said supply reservoir, said guide wall disposed adjacent said shaft so as to seal the inner end of said passageway when said tappet is moved to said open position actuating means disposed within said recess of said casing and mounted on said tappet and slidable along the inner surface of the casing wall defining the outer limit of said open space for effecting movement of said tappet between said normally closed and said open position; and a locking arm mounted between opposed side walls of said outer walls of said casing and wherein said locking arm rotates in a plane perpendicular to said opposed side walls.

14. A device for dosed dispensing of granular or tableted media comprising:

a casing having outer walls defining, at least in part, an interially disposed supply reservoir for said media, an outlet opening, a recess, an open space in communication with said recess but separated from said supply reservoir by at least one inner wall defining, at least in part, a shaft spaced from said outer walls and a duct merging with said outlet opening and at least one bottom wall defining the base of said supply reservoir;

a spring-loaded tappet slidably mounted in said shaft so as to be spaced from said outer walls, said spring-loaded tappet having a passageway therethrough, said passageway having an outer and an inner end thereof, said tappet movable between an open and a normally closed position with respect to said duct merging with said outlet opening, said inner end of said passageway is in communication with said supply reservoir and said outer end of said passageway is sealed by said shaft when said spring-loaded tappet is moved to said closed position and the outer end of said passageway is aligned with said duct when said spring-loaded tappet is moved to said open position;

a guide wall extending from said bottom wall defining the base of said supply reservoir, said guide wall disposed adjacent said shaft so as to seal the inner end of said passageway when said tappet is moved to said open position;

actuating means disposed within said recess of said casing and mounted on said tappet and slidable along the inner surface of the casing wall defining the outer limit of said open space for effecting movement of said tappet between said normally closed and said open position; and a locking arm mounted on said casing, said recess in said casing having a bottom wall and said casing having a support wall spaced below said recess bottom wall and parallel thereto, said recess bottom wall and said support wall defining a lateral opening between opposed side walls of said outer walls of said casing for receiving said safety key.

15. A device for dosed dispensing of granular or tableted media comprising:

a casing having outer walls defining, at least in part, an interially disposed supply reservoir for said media, an outlet opening, a recess, an open space in communication with said recess but separated from said supply reservoir by at least one inner wall defining, at least in part, a shaft spaced from said outer walls and a duct merging with said outlet opening and at least one bottom wall defining the base of said supply reservoir;

a spring-loaded tappet slidably mounted in said shaft so as to be spaced from said outer walls, said spring-loaded tappet having a passageway therethrough, said passageway having an outer and an inner end thereof, said tappet movable between an open and a normally closed position with respect to said duct merging with said outlet opening, said inner end of said passageway is in communication with said supply reservoir and said outer end of said passageway is sealed by said shaft when said spring-loaded tappet is moved to said closed position and the outer end of said passageway is aligned with said duct when said spring-loaded tappet is moved to said open position;

a guide wall extending from said bottom wall defining the base of said supply reservoir, said guide wall disposed adjacent said shaft so as to seal the inner end of said passageway when said tappet is moved to said open position;

actuating means disposed within said recess of said casing and mounted on said tappet and slidable along the inner surface of the casing wall defining the outer limit of said open space for effecting movement of said tappet between said normally closed and said open position; and said shaft is formed by said inner wall, a pair of tappet support walls extending inwardly from said inner wall and forming a U-shaped pocket capturing said spring-loaded tappet and said guide wall forming a bridge for said U-shaped pocket.

16. A device for dosed dispensing of granular or tableted media comprising:

a casing having outer walls defining, at least in part, an interially disposed supply reservoir for said media, an outlet opening, a recess, an open space in communication with said recess but separated from said supply reservoir by at least one inner wall defining, at least in part, a shaft spaced from said outer walls and a duct merging with said outlet opening and at least one bottom wall defining the base of said supply reservoir;

a spring-loaded tappet slidably mounted in said shaft so as to be spaced from said outer walls, said spring-loaded tappet having a passageway therethrough, said passageway having an outer and an inner end thereof, said tappet movable between an open and a normally closed position with respect to said duct merging with said outlet opening, said inner end of said passageway is in communication with said supply reservoir and said outer end of said passageway is sealed by said shaft when said spring-loaded tappet is moved to said closed position and the outer end of said passageway is aligned with said duct when said spring-loaded tappet is moved to said open position;

a guide wall extending from said bottom wall defining the base of said supply reservoir, said guide wall disposed adjacent said shaft so as to seal the inner end of said passageway when said tappet is moved to said open position;

actuating means disposed within said recess of said casing and mounted on said tappet and slidable along the inner surface of the casing wall defining the outer limit of said open space for effecting movement of said tappet between said normally closed and said open position; and said outer walls of said casing beneath said duct merging with said outlet opening forming a second recess which is open towards the bottom of said casing and wherein said bottom wall defining said base of said supply reservoir is formed by an insert inserted within said second recess and wherein said casing walls have stops which define the end position of said insert forming the base of the supply reservoir.

* * * * *